US008360538B2

(12) United States Patent
Retchloff

(10) Patent No.: US 8,360,538 B2
(45) Date of Patent: Jan. 29, 2013

(54) TOOLBOX WITH ELEVATING DISPLAY BACKWALL

(76) Inventor: Barry Kane Retchloff, Earlville, IA (US)

( * ) Notice: Subject to any disclaimer, the term of this patent is extended or adjusted under 35 U.S.C. 154(b) by 0 days.

(21) Appl. No.: 13/240,577

(22) Filed: Sep. 22, 2011

(65) Prior Publication Data

US 2012/0006775 A1 Jan. 12, 2012

Related U.S. Application Data

(62) Division of application No. 11/181,367, filed on Jul. 13, 2005, now Pat. No. 8,033,620.

(51) Int. Cl.
*A47B 81/00* (2006.01)

(52) U.S. Cl. ..... 312/352; 312/902

(58) Field of Classification Search ..... 312/196, 312/902, 306, 312, 319.5, 319.8, 249.1, 249.8, 312/290, 352; 211/70.6, 13.1, 189, 59.1; 248/220.31, 220.41, 220.42, 220.43
See application file for complete search history.

(56) References Cited

U.S. PATENT DOCUMENTS

| | | | | | |
|---|---|---|---|---|---|
| 1,459,930 | A * | 6/1923 | Riehle | 144/285 |
| 2,010,476 | A * | 8/1935 | Boylan | 312/298 |
| 2,019,455 | A * | 10/1935 | Lehman | 312/312 |
| 3,245,741 | A * | 4/1966 | Bartlett | 312/312 |
| 3,297,387 | A * | 1/1967 | Parsons | 312/290 |
| 4,088,380 | A * | 5/1978 | Watts | 312/237 |
| 4,253,715 | A * | 3/1981 | Greiner | 312/21 |
| 4,285,556 | A * | 8/1981 | Loeffel | 312/244 |
| 4,740,044 | A * | 4/1988 | Taylor | 312/196 |
| 5,147,120 | A * | 9/1992 | Ray | 312/111 |
| 5,450,800 | A * | 9/1995 | Leonard | 108/7 |
| 6,213,575 | B1 * | 4/2001 | Brin et al. | 312/140.1 |

* cited by examiner

*Primary Examiner* — James O Hansen
(74) *Attorney, Agent, or Firm* — John Russell Uren

(57) ABSTRACT

A toolbox with drawers for holding tools and the like and a display rack for holding and displaying such tools. The display rack is movable vertically relative to the toolbox and may assume a first tool accessible and tool visible position and a second position where the tools are not accessible and are not visible. A locking mechanism maintains the inaccessible tool position of the display rack. Preloaded struts operate to extend the display rack to its tool accessible and tool visible condition when the retaining force on the display rack is released. A retaining mechanism is used to hold the display rack in its elevated position.

2 Claims, 3 Drawing Sheets

TOOLBOX WITH ELEVATING DISPLAY BACKWALL

CROSS-REFERENCE TO RELATED APPLICATION

This is a division of application Ser. No. 11/181,367 entitled TOOLBOX WITH ELEVATING DISPLAY BACKWALL filed Jul. 13, 2005.

INTRODUCTION

This invention relates to a toolbox and, more particularly, to a toolbox with an elevating backwall or tool display rack which is lockable and which may be raised and lowered relative to the body of the toolbox.

BACKGROUND OF THE INVENTION

Toolboxes used by mechanics are well known in the industry. Such toolboxes are generally mounted on casters and are easily movable from one location on the shop floor to a second location. The tools are conveniently used in either location which makes the absence of unnecessary movement to acquire a tool by the operator attractive.

Back walls or tool display racks are also known for stationary workbenches and the like. The use of back walls or display racks to hold tools which are readily visible to the operator and which can be conveniently handled if required is also known. Backwalls on portable toolboxes are less well known but they are an attractive feature. A job may involve the repeated use of a single set of tools. Allowing those tools to be displayed and to be readily available for use by the operator is desirable.

Portable castering-like toolboxes generally remain at the jobsite in the absence of the owner or operator of the toolbox. Allowing the toolbox to be locked will protect the tools in the toolbox from theft or pilferage or borrowing since the weight of the toolbox and its size deters theft of the toolbox itself. If the display rack is not lockable, the tools displayed on the backwall must be removed and installed in the body of the toolbox when the operator is absent which is disadvantageous. Likewise, to reduce the profile of the toolbox and to assist in moving the toolbox on its casters, it would be convenient if the backwall was retractable relative to the body of the toolbox.

In U.S. Pat. No. 1,459,930 (Riehle), there is disclosed a toolbox with a vertical tool display rack which is elevatable by a mechanical ratchet device. There is no provision for easy extension of the display rack and there is no provision for locking the display rack relative to the toolbox so that the tools are secured.

SUMMARY OF THE INVENTION

According to one aspect of the invention, there is provided a toolbox for holding tools, said toolbox having a main body with a plurality of drawers movable generally horizontally and an extendible tool display rack which moves generally vertically from a retracted position to an extended position relative to said main body without the addition of force external to said toolbox upon the release of said extendible tool display rack from said main body.

According to a further aspect of the invention, there is provided a method of displaying tools on a generally vertically oriented display rack, said display rack being a part of a tool box having a main body with generally horizontally movable drawers used to hold tools, said method comprising maintaining said display rack stationary relative to said main body of said tool box and releasing said display rack from said main body to allow said display rack to move generally vertically and upwardly relative to said main body without force external to said toolbox, thereby to allow said display rack to assume an extended position and to expose a display surface on which tools may be displayed.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
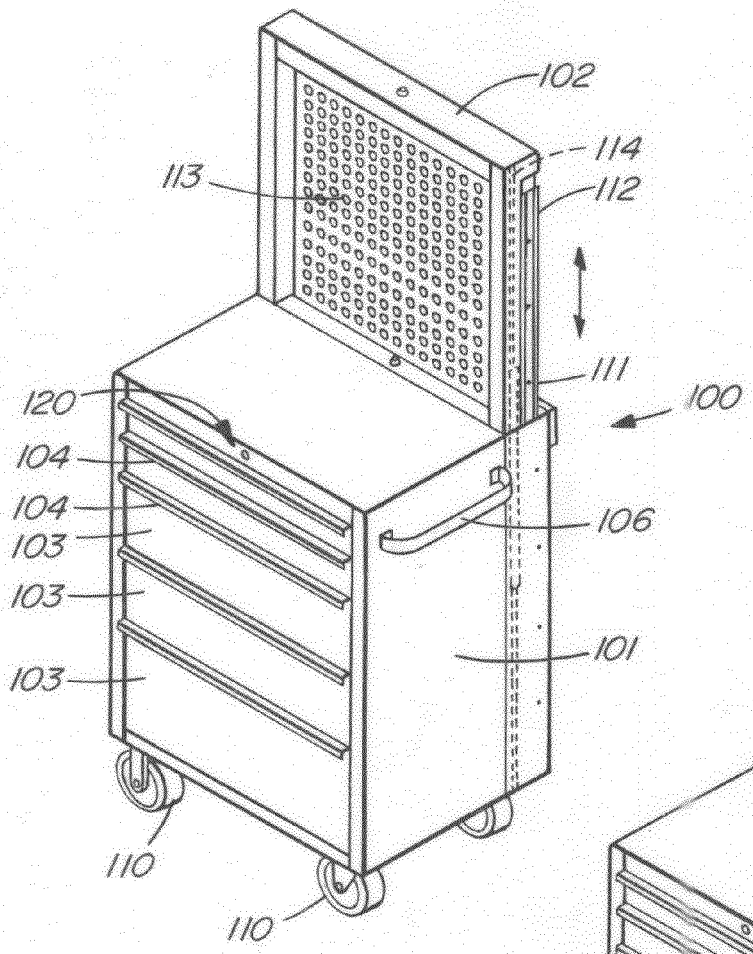
FIG. 1 is a diagrammatic isometric view of a toolbox according to the invention illustrating the display rack in its elevated and extendible position.

Referring now to the drawings, a toolbox is illustrated generally at 100 in FIG. 1. The toolbox 100 has a main body portion generally illustrated at 101 and an extendible tool display rack generally illustrated at 102. A plurality of drawers 103 are mounted in the main body portion 101 and are movable generally horizontally relative to the main body portion 101. Each of the drawers 103 is adapted to hold tools used by a mechanic or operator and each of the drawers 103 has an upper and outwardly extending handle 104 which is easily grasped by the fingers of the operator in order to extend the drawers 103 from their generally closed position within the main body portion 101. A plurality of castering wheels 110 are mounted to the bottom of the toolbox 100 to allow for movement of the toolbox 100 from one working position to another working position and a handle 106 is conveniently located so as to be accessible to the operator when the operator wishes to move the toolbox 100 to a different position.

The display rack 102 is extendible and retractable relative to the main body portion 101 of the toolbox 100 as indicated by the arrows in FIG. 1 and as will be described in greater detail. The display rack 102 has a set of slides 112 which move generally vertically within slide guides 111. The display rack 102 has a removable pegboard surface 113 which allows a plurality of hooks (not illustrated) to be mounted to the pegboard 113 which then allows the tools desired to be hung from the hooks so as to be readily visible and accessible to the operator.

Figure 2:
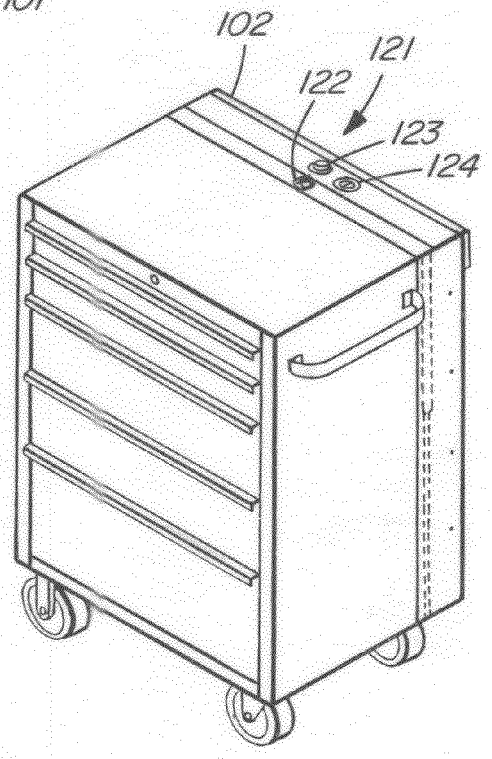
FIG. 2 is a diagrammatic isometric view of the toolbox according to the invention illustrating the display rack in its unextended and retractable position and further illustrating the display rack retention and locking buttons.
Figure 3:
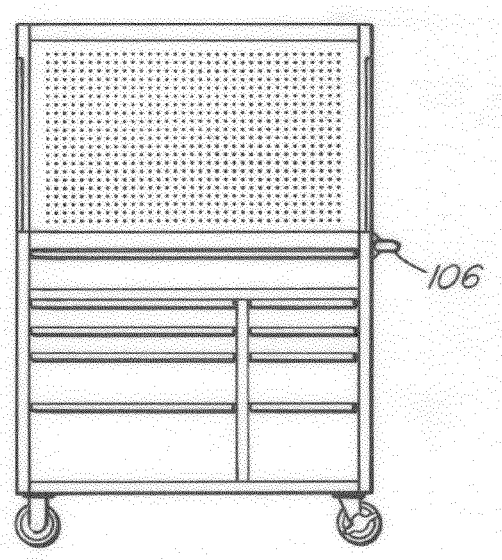
FIG. 3 is a diagrammatic front view of the toolbox showing the display rack in its extended position similar to the position illustrated in FIG. 1.
Figure 4:
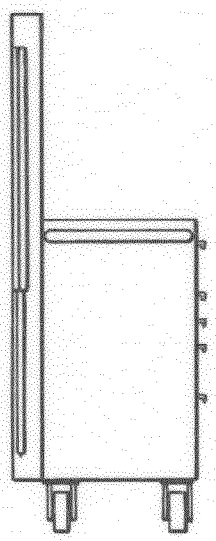
FIG. 4 is a side view of the toolbox of FIG. 3 illustrating the rack within which the side rails of the display rack move during generally vertical movement of the display rack and further illustrating the gas struts used to extend the display rack from its retracted position.

The display rack 102, when retractable, makes the pegboard surface 113 and the tools hung therefrom inaccessible. Thus, when the display rack 102 is in its downwardly or retracted position as shown in FIG. 2, no tools will be displayed. A pair of gas holding struts 114 (FIG. 1) are connected to the top of the sides of the display rack 102 and the bottom of the main body portion 101. The gas struts 114 are in a compression mode when they are in their compressed position; that is, when the display rack 102 is in its retracted and locked position as illustrated in FIG. 2. When the display rack 102 is released by unlocking and releasing it as will be described, the gas struts 114 will extend the display rack 102 to its fully extended position without the necessity of external force being required. When the external display rack 102 is desired to be moved to its retracted position, a manual external force by the user will be applied downwardly on the display rack 102 until it assumes its retracted position wherein the gas struts 114 are in their compressed and loaded condition.

A first locking mechanism generally illustrated at 120 is provided for the toolbox 100. The locking mechanism 120 comprises a rod rotatable by a key (not illustrated). When the rod is in the locked position, the drawers 103 are maintained in their closed position so as to prevent access to the tools in the drawers 103 when it is so desired by the owner of the toolbox 100 or the operator using the toolbox 100. The drawer locking mechanism 120 is known to those skilled in the art and forms no part of the present invention.

Figure 5A:
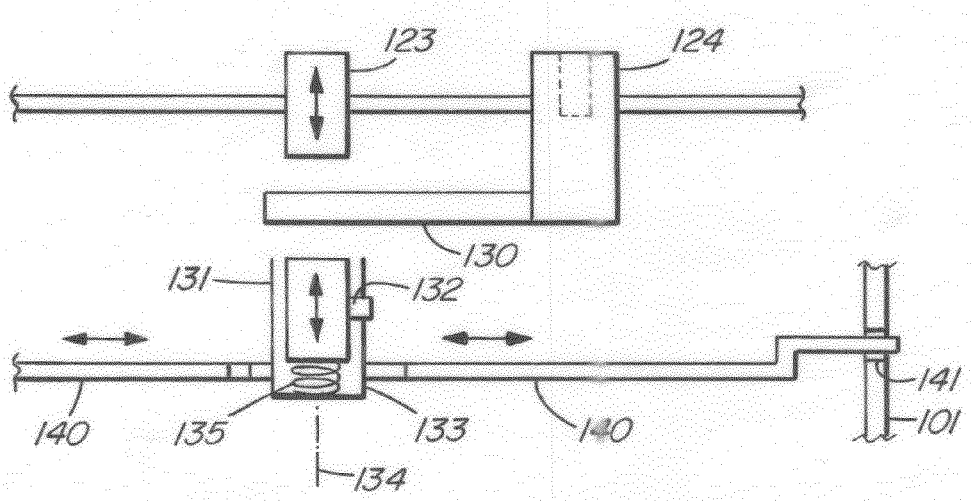
FIGS. 5A, 5B and 5C are diagrammatic illustrations of the details of the display rack locking and release buttons.
Figure 5B:
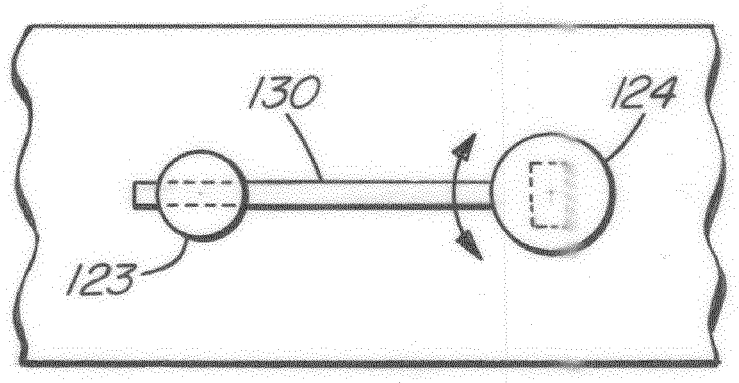
Figure 5C:
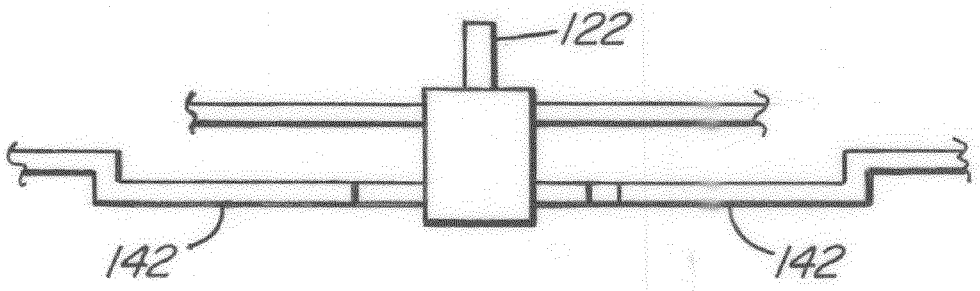

A second locking mechanism for the display rack 102 is generally illustrated at 121 (FIG. 2) and comprises a rotatable knob 122, a pushbutton 123 and a keylock 124. A key (not illustrated) is inserted in the keylock 124 and the keylock 124 is rotated as seen in FIGS. 5A and 5B. A shaft 130 is rotated from beneath the pushbutton 123 and allows the pushbutton 123 to subsequently be depressed as illustrated by the arrows. A second vertically movable and spring loaded follower 131 is then moved by pushbutton 123 following contact between them. The vertically movable follower 131 has a horizontally extending protuberance 132 which is received within a groove or cammed surface (not shown) in a receptacle 133. The receptacle 133 rotates about a vertical axis 134 under the influence of the vertical movement of protuberance 132 and is attached to lock bars 140 through a pivotal connection. As receptacle 133 rotates, the lock bars 140 move inwardly and out of contact with cabinet slots 141 (only one of which is shown) in the body 101. When the force on pushbutton 123 is removed, the follower 131 will move upwardly under the influence of the spring 135 and the receptacle 133 will rotate to allow the lock bars 140 to again extend into the slots 141. Upon disengagement of the lock bars 140 with the slots 141, the display rack 102 is free to move upwardly under the influence of the gas loaded struts 114 and it does so without the necessity of external force being applied by the operator. The display rack 102 will reach its uppermost position and the twist lock 122 (FIG. 5C) in the lower portion of the display rack 102 will then be rotated. The twist lock 122 is connected to an additional set of lock bars 142 which operate in the same manner as the lock bars 140 just described. They retain the display rack 102 in its extended position by entering into the slots 141 in the main body 101.

This retention of the display rack 102 in its elevated position by the lock bars 142 prevents the weight of the tools on the display rack 102 from constantly pushing on the struts 114 and reduces or eliminates any impact forces thereby allowing an extended life for the struts 114 and for increased stability of the extended display rack 102.

To lower the display rack 102, the operator will twist knob 122 thereby withdrawing the lock bars 142 from the slots 141 in the main body 101. A downwardly directed force will be applied to the display rack 102 by the operator and, when the display rack 102 reaches its fully retracted position, the spring loaded lock bars 140 will automatically again engage with the lock slots 141 on the main body 101. The operator will turn the key to rotate the push lock 124 so the pushbutton 123 cannot be activated to allow extension of the display rack 102 and thereby display the tools until desired by the user. The tools on the display rack 102 are thereby secured.

Operation

In operation, it will be assumed that the toolbox 100 is in the condition illustrated in FIG. 2; that is, the display rack 102 will be in its fully retracted or downwardly located position and the pegboard surface 113 (FIG. 1) will not be visible. Any tools hanging from hooks on the pegboard surface 113 will be inaccessible. It will also be assumed that the toolbox 100 will be in the locked condition with both the locking mechanisms 120, 124 being in use. The tools in the drawers 102 and on the display rack 102 will thereby not be accessible.

The owner or authorized user will insert a key into the first locking mechanism 120 and will rotate the key which will allow the drawers 102 to be pulled outwardly into their open position by their handles 104 where tools in the drawers 102 are readily accessible. Likewise, the user will rotate the lock 124 which will rotate rod 130 out of operating engagement with pushbutton 123 and allow pushbutton 123 to be depressed and to contact follower 131.

Upon rotation of receptacle 131, the lock bars 140 will be retracted from the slots 141 in the sides of the main body 101 and the display rack 102 will no longer be retained by the lock bars 140. The display rack 102 will therefor move upwardly under the influence of the gas struts 114 without the need for additional and external force until the display rack 102 reaches its fully extended position. In this position, knob 122 is rotated to allow lock bars 142 to enter the receiving slots 141 in the main body 101. The tool weight will be borne by the lock bars 142 and their receiving slots 141 thereby reducing the impact effect of the variable forces on the display rack 102 and therefore extending the operating life of the gas loaded struts 114.

When it is desired to lower the display rack 102, knob 122 is rotated to withdraw the lock bars 142 from the slots 141. A downwardly directed force will be applied on the display rack 102 until its lowermost and retracted position is reached at which point the lock bars 140 operably connected to pushbutton 123 will, under the influence of the spring loading on the follower 131, enter the slots 141 on the main body 101.

To lock the toolbox 100 and the display rack 102, the keylock 124 will be rotated to prevent the pushbutton 123 from accessing the follower 131 (FIG. 5A) and the locking mechanism 120 will be rotated to prevent access to the drawers 103. The toolbox 100 will then be in its fully locked condition.

Many modifications will readily occur to those skilled in the art. The locking mechanisms 120, 124, while being described as each being independent, could be made into a single mechanism for locking both the drawers 103 and the display rack 102 simultaneously. Similarly, while the display rack 102 has been described as being under the influence of gas strut type cylinders 114 used to extend the display rack 102, other oil or pneumatic type struts or even mechanically spring loaded cylinders are contemplated.

Many further modifications in addition to those specific embodiments disclosed will readily occur to those skilled in the art to which the invention relates and the specific embodiments described should be taken as examples of the invention only and not as limiting its scope as defined in accordance with the accompanying claims.

I claim:

1. A method of displaying tools on a generally vertically oriented display rack, said display rack being an integral part of a tool box having a main body with side panels and generally horizontally movable drawers used to hold tools, said tool box being portable to move from one position to another with the use of wheels or casters on the bottom of said tool box, said method comprising maintaining said display rack stationary relative to said main body of said tool box and releasing said display rack from an extracted position in said main body to allow said display rack to move generally vertically and upwardly relative to said main body to an extracted position without force external to said toolbox, said display rack extending across substantially the entire width of said toolbox between said side panels and including a generally vertical display surface for hanging and displaying tools with said display surface having a recess sufficient to allow the mounting and displaying of tools on said display surface and to allow the display surface to move between said extended and said retracted positions with said tools being mounted on said display surface, said display rack being movable from a retracted position by at least one strut connected between said display rack and said main body which is pretensioned to exert a force on said display rack when said display rack is in said retracted position, locking said display rack in said retracted position with a key lock until a key is inserted into said key lock, extending a first arm between said display rack and said main body to prevent relative movement between said display rack and said main body when engaged, allowing relative movement between said display rack and said main body when said first arm is moved out of engagement between said display rack and said main body with a first arm movement means which is operably engaged with said key lock, allowing said key lock to release engagement of said first arm and said main body with said first arm movement means and with a key inserted into said key lock, said force on said strut being sufficient to raise said display rack into said extended position without external force on said display rack, and restraining relative movement between said main body and said display rack with a second arm extending between said display rack and said main body when said display rack is in said extended position thereby to allow said display rack to assume an extended position and to expose a display surface on which said tools may be displayed.

2. Method as in claim 1 wherein said strut is gas, pneumatic, hydraulic or mechanically powered.

* * * * *